United States Patent [19]

Zordan

[11] Patent Number: 4,852,775

[45] Date of Patent: Aug. 1, 1989

[54] POURING COVER FOR PAINTS, ENAMELS AND THE LIKE

[76] Inventor: Daniele Zordan, Via Solone, 7, Monza (Milano), Italy

[21] Appl. No.: 120,346

[22] Filed: Nov. 13, 1987

[51] Int. Cl.[4] ..... B65D 25/42

[52] U.S. Cl. ..... 222/569; 215/344; 222/570

[58] Field of Search ..... 222/569, 570; 215/344, 215/342; 220/353

[56] References Cited

U.S. PATENT DOCUMENTS

| | | | |
|---|---|---|---|
| 2,636,643 | 2/1947 | McCauley | 222/569 X |
| 3,055,526 | 9/1962 | Plunkett | 215/344 X |
| 3,596,813 | 8/1971 | Munn | 222/569 |
| 4,353,489 | 10/1982 | Arnold et al. | 222/570 |
| 4,708,255 | 11/1987 | Thompson | 215/344 X |

FOREIGN PATENT DOCUMENTS

| | | | |
|---|---|---|---|
| 723545 | 2/1955 | United Kingdom | 215/344 |

*Primary Examiner*—Joseph J. Rolla
*Assistant Examiner*—Boris Milef
*Attorney, Agent, or Firm*—Bucknam and Archer

[57] ABSTRACT

The cover includes a cover body provided with a pouring spout with a metering gate member and operating cam members for coupling the cover body to the inner edge of a paint can or the like, and a lip gasket arranged under the perimetrical edge of the cover member and acting on the top portion of the can and coupled to the cover body through a loop portion for providing resiliency in the axial direction.

1 Claim, 2 Drawing Sheets

POURING COVER FOR PAINTS, ENAMELS AND THE LIKE

BACKGROUND OF THE INVENTION

The present invention relates to a pouring cover structure which has been specifically designed for pouring paints, enamels and the like.

As is known, for painting car bodies in body shops and plants, there are presently used paints or enamels of given base colors which are mixed, depending on requirements, with the desired rates in order to provide the proper tonality colors.

In order to pour the paints or enamels from the cans containing them, there are generally used pouring lids which consist of a cover structure which is coupled to the can edge by means of cam shaped members which operate so as to axially clamp the cover on the can.

In this connection, it should be pointed out that the can edge is frequently affected by flatness drawbacks, thereby the cover can not be fitted thereto with the required clamping force and tightness.

Another drawback of the known pouring covers is that a possible thickness or shape unevenness of the can edge can cause paint leaks during the paint pouring operation.

SUMMARY OF THE INVENTION

Accordingly, the main task of the present invention is to overcome the above mentioned drawbacks, by providing a pouring cover, specifically designed for pouring paints, enamels and the like, which may be applied with a perfect tightness to the paint cans, even if the edge of the cans is not perfectly flat.

Another object of the present invention is to provide a pouring cover structure which may be fitted to the paint cans in a simple and quick way, while providing a perfect tightness at all of the contact points of the cover and can edge.

Yet another object of the present invention is to provide such a pouring cover structure which is highly reliable and safe in operation.

Yet another object of the present invention is to provide such a pouring cover structure which can be made starting from easily available materials and elements and which, moreover, is of very reduced cost.

According to one aspect of the present invention, the above mentioned objects, as well as yet other objects, which will become more apparent thereinafter, are achieved by a pouring cover structure, specifically designed for pouring paints, enamels and the like, comprising a cover body provided with a pouring spout, with a metering gate member and cam members for coupling said cover body to the inner edge of a paint cans and the like, characterized in that it further comprises a lip gasket, arranged under said cover body perimetrical edge and acting on the top portion of said cover body edge.

BRIEF DESCRIPTION OF THE DRAWINGS

Further characteristics and advantages of the present invention will become more apparent from the following detailed description of a pouring cover structure, which has been specifically designed for pouring paints, enamels and the like, and which is shown, by way of a not limitative example in the figures of the accompanying drawings, where.

DESCRIPTION OF THE PREFERRED EMBODIMENT

Figure 3:
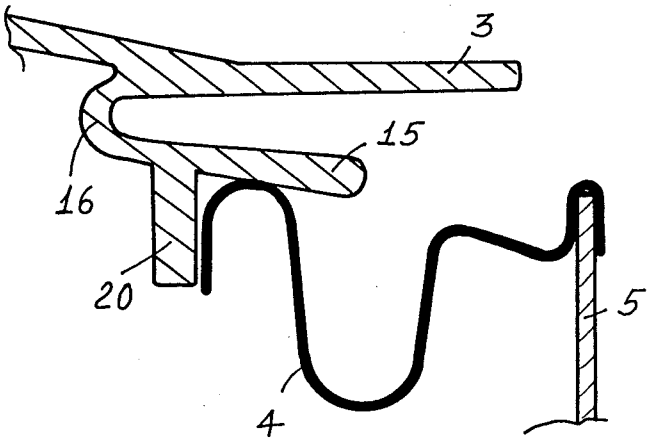
FIG. 3 is a cross-sectional view, on an enlarged scale, of the gasket member included in the pouring cover according to the invention, before the clamping of the cover on the can.

With reference to the figures of the drawings, the pouring cover structure, according to the present invention, which has been specifically designed for pouring paints, enamels and the like, and which is indicated at the reference number 1, comprises a cover body 2 which, as is conventional, has a substantially bulged shape and is provided with a perimetrical edge 3 provided for engaging with the inner edge 4 of a paint can 5 or the like.

The cover body 2 is provided with a pouring small spout 6 which is controlled, in order to provide a perfect metering of the poured paint material, by a gate member 7 which may be operated by means of a level push-button 8.

The cover body may be coupled to the can 5, in a known way, by means of cam members 9 engaging with the can inner edge at its bottom portion and which are operated by means of small levers 10 accessible on the outer portion of said cover body.

The cover body is moreover provided with a pin member, not shown in the drawings, thereto a stirring member is coupled for properly stirring the paint.

The main feature of the cover according to the present invention is that said cover body is further provided, under the perimetrical edge 3, with a lip gasket member 15 which perimetrically extends and is arranged so as to effect the top or upper portion of the edge 4 of the paint can 5.

As the cover body 2 is made of a metal material, the lip gasket member will be made of a plastic material and will be arranged under the perimetrical edge 3.

As the cover body 2 is made of a plastics material, the lip gasket member 15 will be formed in a single piece with said cover body 2.

The gasket member 15, in order to provide the desired clamping resiliency in the axial direction and to adjust possible flatness defects of the edge 4, is coupled to the cover body 2 by means of a loop portion 16 able of providing the desired resiliency against the axial compression exerted as the can cover i s applied.

As is shown, on the gasket member 15 there are provided axial projections 20 adapted for centering the cover body with respect to the can edge.

Figure 4:
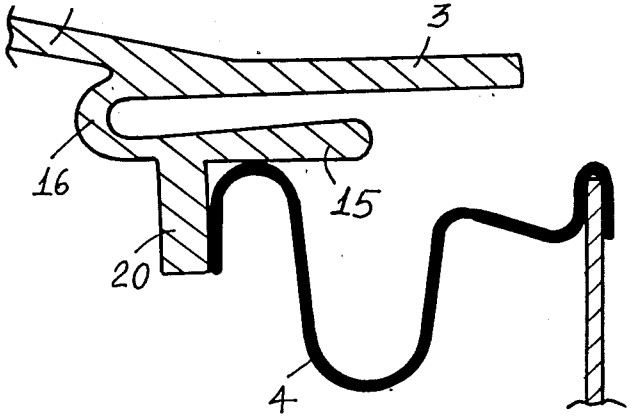
FIG. 4 is another cross-sectional view, on an enlarged scale, representing the lip gasket member during the clamping of the cover, in its tightness condition.
Figure 1:
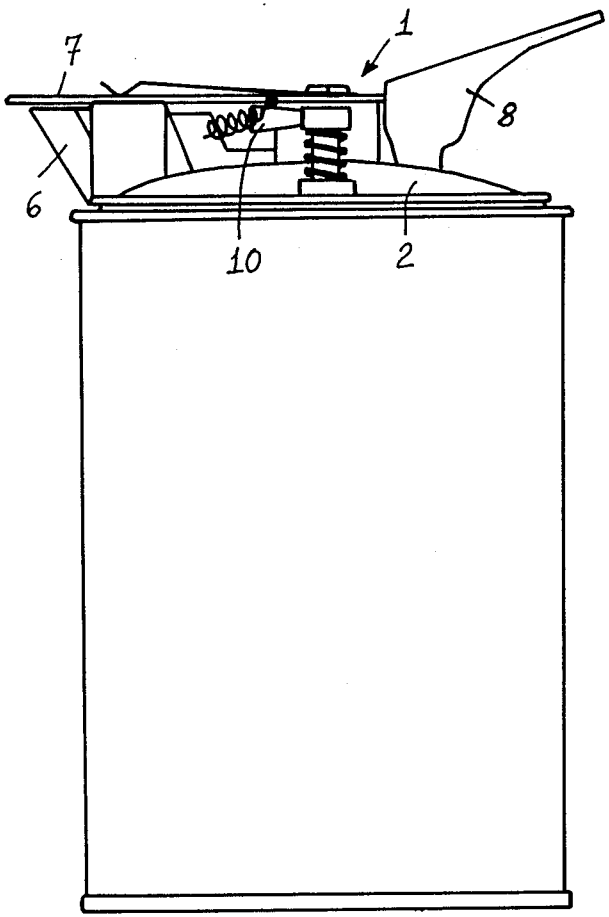
FIG.1 schematically shows the pouring cover structure according to the present invention applied to a can.
Figure 2:
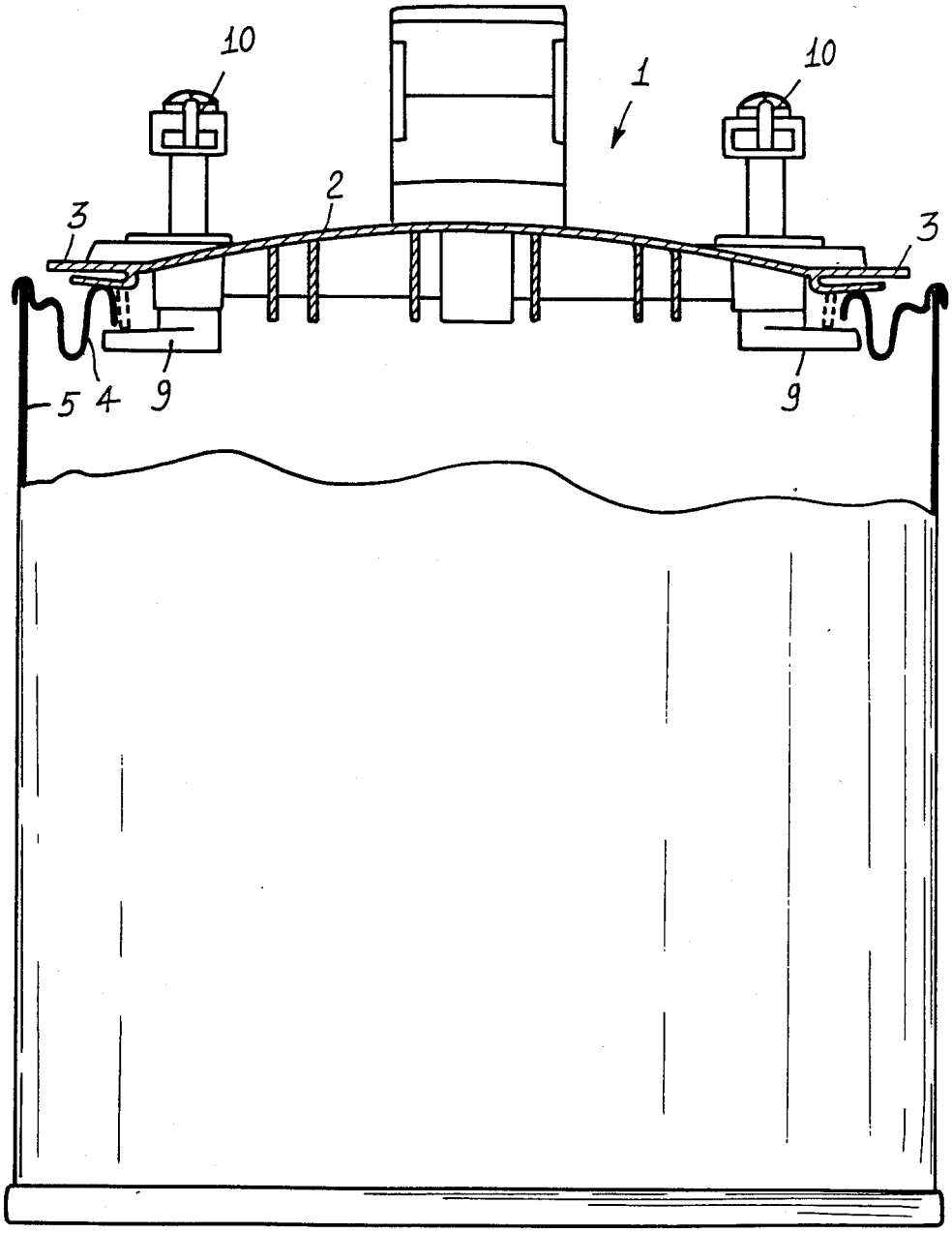
FIG.2 is a cross-sectional view illustrating the pouring cover structure according to the invention applied to a can.

The provision of the lip gasket member 15, which is axially pressed, as is schematically shown in FIG. 4, as the cover is clamped on the can, affords the possibility of obtaining a perfect tightness, since said lip gasket member may fit to the shape of the edge 4, even if said edge is not perfectly flat.

From the above disclosure it should be apparent that the invention fully achieves the intended objects.

In particular it should be pointed out that a cover has been disclosed which, owing to the provision of a lip gasket member arranged on its perimetrical edge, provides the advantage of assuring a precise and perfect tightness in all of the use conditions.

Another important aspect of the invention is that the gasket may be easily made.

In practicing the invention the used materials as well as the specific shapes and sizes may be any according to requirements.

I claim:

1. A pouring cover structure, specifically designed for pouring paints, enamels and the like, comprising a cover body provided with a pouring spout with a metering gate member and operating cam members for coupling said cover body to the inner edge of a paint cam or the like, a resilient lip gasket member arranged under the perimetrical edge of said cover member and adapted to engage the top portion of said can, said resilient lip gasket member being coupled to said cover body through a resilient loop portion integral with said resilient lip gasket member to provide resiliency in the axial direction of said can, said resilient lip gasket member further comprising integral axial resilient projections to be deflected against the inner edge of said can as an axial closure force is exerted on said resilient loop portion, said resilient lip gasket member depending from said perimetrical edge by said resilient loop portion, said resilient lip gasket member having upper and lower surfaces and said axial resilient projections depending from the lower surface of said resilient lip gasket member.

* * * * *